US007095867B2

(12) United States Patent
Schul et al.

(10) Patent No.: US 7,095,867 B2
(45) Date of Patent: Aug. 22, 2006

(54) PORTABLE AUDIO REPRODUCTION SYSTEM

(75) Inventors: Eran Schul, Goshen, NY (US); Eric Aaron Langberg, Milford, PA (US); David Burke, Henryville, PA (US)

(73) Assignee: Altec Lansing Technologies, Inc., Milford, PA (US)

( * ) Notice: Subject to any disclaimer, the term of this patent is extended or adjusted under 35 U.S.C. 154(b) by 32 days.

(21) Appl. No.: 10/836,113

(22) Filed: Apr. 30, 2004

(65) Prior Publication Data

US 2005/0244025 A1 Nov. 3, 2005

(51) Int. Cl.
*H04R 1/02* (2006.01)
*H04R 9/06* (2006.01)

(52) U.S. Cl. ..... 381/334; 381/386

(58) Field of Classification Search ..... 381/334, 381/386, 333; D14/204; 181/198, 199
See application file for complete search history.

(56) References Cited

U.S. PATENT DOCUMENTS

| | | | | |
|---|---|---|---|---|
| 3,683,530 | A * | 8/1972 | Robinson | 40/215 |
| 4,450,495 | A * | 5/1984 | Naruki | 360/137 |
| 4,580,653 | A | 4/1986 | Owens | 181/141 |
| 5,283,862 | A * | 2/1994 | Lund | 345/173 |
| 5,546,468 | A | 8/1996 | Beard | 381/86 |
| 5,647,007 | A | 7/1997 | Wooderson et al. | 381/90 |
| 5,675,426 | A | 10/1997 | Meisner et al. | 358/838 |
| 5,732,140 | A | 3/1998 | Thayer | 381/24 |
| 5,802,194 | A | 9/1998 | Yamagishi et al. | 381/188 |
| 5,933,507 | A | 8/1999 | Woolley et al. | 381/300 |
| 5,979,591 | A | 11/1999 | Harrison | 181/199 |
| 6,057,659 | A | 5/2000 | Akiyama et al. | 318/386 |
| 6,169,847 | B1 * | 1/2001 | Mizoguchi et al. | 386/111 |
| 6,176,346 | B1 | 1/2001 | Wiener | 181/199 |
| 6,178,514 | B1 * | 1/2001 | Wood | 713/300 |
| 6,374,148 | B1 * | 4/2002 | Dharmarajan et al. | 700/94 |
| 6,392,871 | B1 | 5/2002 | Yanase | 361/681 |
| 6,618,042 | B1 * | 9/2003 | Powell | 345/204 |
| 6,742,185 | B1 * | 5/2004 | Andrews | 725/75 |
| 6,819,939 | B1 | 11/2004 | Masamura | 455/550 |
| 6,933,928 | B1 * | 8/2005 | Lilienthal | 345/173 |
| 2002/0146140 | A1 * | 10/2002 | Chiu | 381/332 |
| 2004/0212968 | A1 * | 10/2004 | Lin | 361/755 |
| 2004/0268004 | A1 * | 12/2004 | Oakley | 710/303 |
| 2005/0053365 | A1 * | 3/2005 | Adams et al. | 386/125 |

* cited by examiner

*Primary Examiner*—Vivian Chin
*Assistant Examiner*—Jason Kurr
(74) *Attorney, Agent, or Firm*—Adam Landa; Richard E. Kurtz, II; Greenberg Traurig, LLP

(57) ABSTRACT

A portable system capable of receiving audio signals from one or more sources and reproducing the signals via speakers contained therein. The portable audio reproduction system can include a docking station or similar means for communicatively coupling an audio device to the portable audio reproduction system, thereby reducing desktop clutter and simplifying connecting the portable audio reproduction system with the audio device. The speakers of the portable audio reproduction system can preferably be received within a base portion of the system, thereby protecting the speakers during transport and reducing the overall size of the system for improved portability. External connections may also be provided, thereby enabling the portable audio reproduction system to receive audio signals from additional sources, and a mixer allows the system to reproduce signals from a portable audio device and an auxiliary source, such as a computer.

32 Claims, 19 Drawing Sheets

PORTABLE AUDIO REPRODUCTION SYSTEM

PRIORITY CLAIM

This application claims priority from U.S. Design patent application Ser. No. 29/191,799, filed Oct. 15, 2003, which is hereby incorporated by reference in its entirety.

FIELD OF THE INVENTION

The present invention relates to the field of portable audio equipment, and more particularly to a portable device for reproducing audio signals.

BACKGROUND OF THE INVENTION

The past several decades have seen remarkable advances in audio reproduction equipment, particularly equipment that allows a variety of audio tracks to be carried or transported with a user from one location to another. Such equipment includes, e.g., equipment for digitally recording, editing, mixing, producing, storing and reproducing audio tracks. Digital files are advantageous for several reasons, including the fact that error correction algorithms can be run on the files to guarantee that the audio track data in the files is properly stored, which means that the audio can be faithfully reproduced even where an underlying recording medium induces errors or where errors are induced in the copy process. Another advantage of digital files is that reproduction equipment can precisely control the speed at which the audio track is played, thereby effectively guaranteeing consistent playback. However, because of the limited processing speed of computers and digital signal processors at the time, the digital versions of the audio tracks were relatively large files, and a new means for storing large amounts of data on a relatively small media was necessitated. This lead to the development of the Audio Compact Disc, or CD.

Early CD's were designed to hold seventy-two minutes of music, almost as much as the larger cassette tapes that were in popular use at the time. By putting the CD in an appropriate reproduction device, or player, the CD could consistently reproduce audio from the audio track data stored thereon. The recording techniques used to generate the digital files also tended to sample a wider frequency range than could be stored on and reproduced from traditional magnetic media, making the reproduction more faithful than was experienced with cassette and 8-track tape players, and frequently rivaled or exceeded that of even high-end reel-to-reel systems.

Because of the many advantages of CD's over magnetic media and phonographic records, CD's quickly gained popularity. This lead to an ever-increasing number of digital audio tracks being available to individual users. As computer processing speeds and technology has continued to increase, new algorithms for storing audio tracks have emerged. One of the more popular of these new audio track storage algorithms is the Motion Picture Entertainment Group level 3 algorithm, commonly referred to as the MP3 algorithm. The MP3 algorithm uses a variety of techniques, including allowing users to vary the audio track sampling rate as the audio track is recorded, varying the number of bits used to represent a given frequency range, and the like, to generate digital audio track files that are significantly smaller than those used on CD's. This means that users can carry more audio data files on a given medium than they could in the past. For example, a typical seventy-two minute audio CD holds approximately 650 MB of data. Depending on the compression methods chosen, a 650 MB CD-ROM can easily hold several hours' worth of compressed music.

As digital storage capacity continues to increase and compression algorithms continue to advance, users are able to carry more and more of the music they like with them. This has resulted in the incorporation of audio track reproduction capabilities in an ever-increasing array of audio-capable devices, including, but not limited to, digital cameras, portable digital assistants (commonly referred to as PDA's), wireless telephones, and the like. Several other devices have been introduced into the market that are predominately used for reproduction of compressed audio tracks. These devices are generally referred to as portable music players, or PMP's. One of the most popular PMP's is the iPod, sold by Apple Computer, Inc. of Cupertino, Calif. The iPod has become popular because it has a relatively small form factor but can store many tens of gigabytes of audio files and other information on a hard disk drive stored within the PMP.

SUMMARY OF THE INVENTION

Most of the currently available audio devices are designed to be highly portable and to allow an individual to carry a relatively large number of audio tracks. However, because design of these devices has centered on portability, the manufacturers tend to limit them so as to present the reproduced audio to a user only through monaural or stereo headphones that are plugged into the audio device. This means that, at best, these audio devices can only be used to reproduce audio tracks for a limited number of users, such as where one or more splitters are used to allow multiple users to plug headphones into the device. However, because the audio devices are typically battery powered, they are not capable of generating enough energy to power several pairs of headphones. Furthermore, increasing the number of users connected to a single device beyond one or two limits the device's portability.

One method alternative employed by some in the prior art is to allow users to attach speakers to an audio device. This allows multiple users to experience audio tracks at the same time. Because the power output of audio devices is typically relatively low, it is frequently advantageous for the speakers to include an amplifier which is powered by an external power source. By way of example, without intending to limit the present invention, some in the prior art have created relatively small, battery powered or alternating current (AC) powered speakers for use with portable audio reproduction equipment. One limitation of such powered speakers is that they are frequently sold as stand-alone units, without a carrying case or other means for simplifying their transportation. The speakers also tended to take a lot of physical abuse during transportation, and frequently the cables and adaptors used to connect the speakers to the audio device are not capable of withstanding such abuse.

The present invention is directed to a portable audio reproduction system that substantially obviates one or more of the problems due to limitations and disadvantages of the related art. Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

The present invention is a portable audio reproduction system preferably consisting of a plurality of powered speakers housed in a protective case, wherein the protective case also preferably functions as part of a stand for the speakers. This stand is preferably designed to facilitate positioning the speakers at an optimum angle to enhance enjoyment of reproduced audio tracks. The speaker amplifier can preferably be powered by batteries or an AC power source, although it should be apparent to one skilled in the art that purely battery powered and purely AC powered speaker amplifiers can be substituted therefor without departing from the spirit or the scope of the invention.

The portable audio reproduction system of the present invention is preferably designed to be communicatively coupled with one or more audio devices. In one embodiment, the present invention preferably includes an adaptor by which the portable audio reproduction system can be connected to one or more PMP's. By way of example, without intending to limit the present invention, the portable audio reproduction system may include a docking cradle for attaching an iPod to the portable audio reproduction system, thereby allowing the portable audio reproduction system to reproduce audio signals from the iPod. In an alternative embodiment, the docking cradle provided by the present invention may support multiple, interchangeable connection means, thus allowing a plurality of PMP's, satellite radio receivers, digital radio receivers, standard radio receivers, CD players, or other audio devices to be communicatively coupled with the portable audio reproduction system. The signal received by the system from the audio device may be either digital or analog, and the audio device may be detachable from the system or permanently connected.

In addition to communicatively coupling through a docking port or the like, a preferred embodiment of the present invention also allows external devices, such as, but not limited to, audio signals from a computer, secondary audio device, or the like, to be communicatively coupled to the portable audio reproduction system through a standard audio connector. Electronic mixing circuitry preferably allows audio signals from the external device to be input to, and reproduced by, the portable audio reproduction system in conjunction with an audio signal from an attached PMP or other device.

An adapter may also be provided by which the present invention can be mated with higher fidelity audio equipment. Such higher fidelity audio equipment may include, but is not limited to, a subwoofer or a home theater system. This can further enhance the audio fidelity and reproduced frequency range of the system.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of at least one embodiment of the invention.

In the drawings.

DETAILED DESCRIPTION OF THE PREFERRED EMBODIMENT

Reference will now be made in detail to the preferred embodiments of the present invention, examples of which are illustrated in the accompanying drawings. For clarity, corresponding features are consistently labeled across the various views of the invention provided in the figures.

Figure 1:
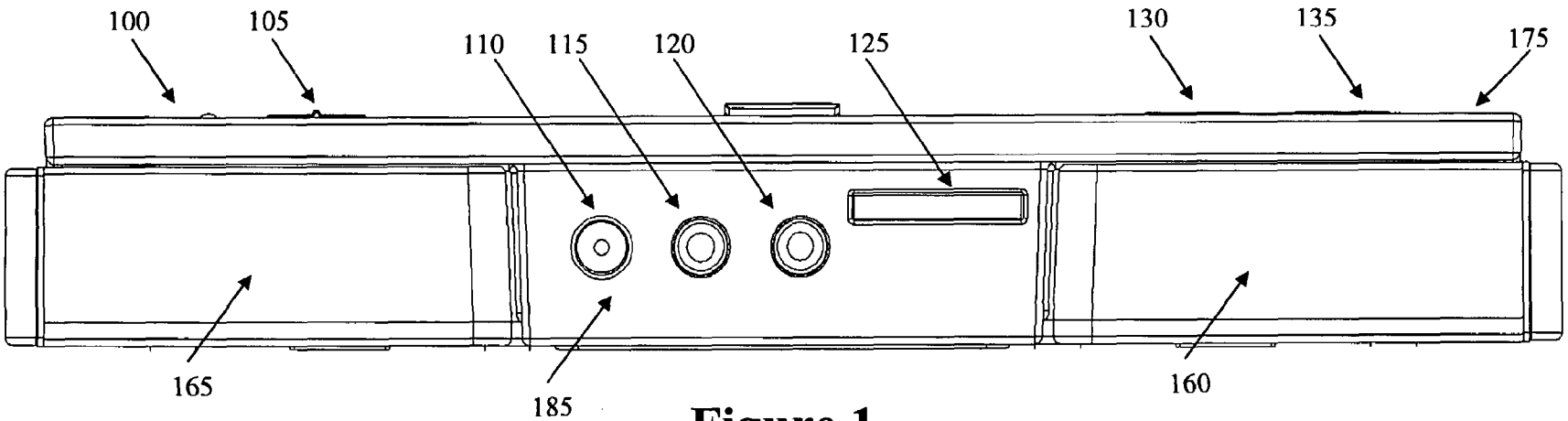
FIG. 1 is a rear planar view of a preferred embodiment of the invention when closed.
Figure 2:
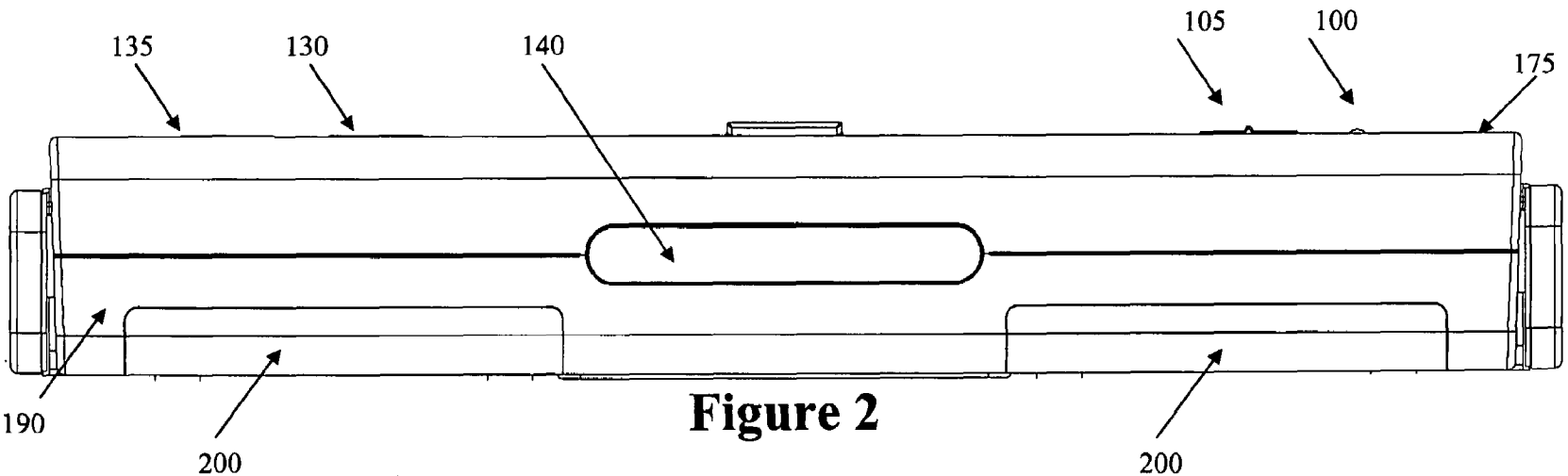
FIG. 2 is a front planar view of a preferred embodiment of the invention when closed.
Figure 3:
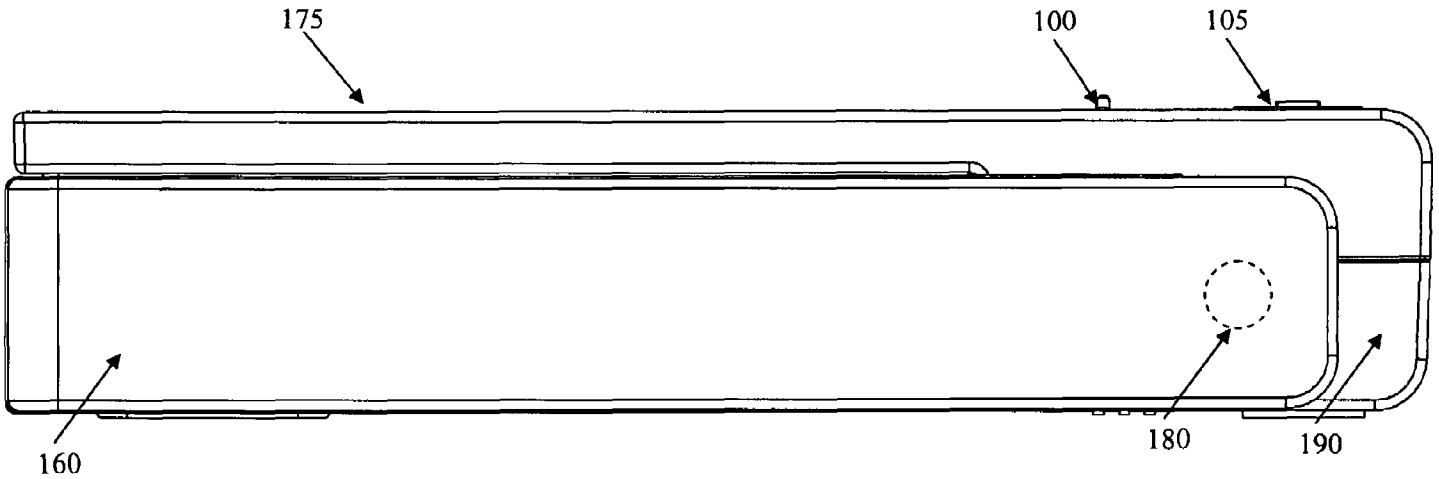
FIG. 3 is a left planar view of a preferred embodiment of the invention when closed.
Figure 4:
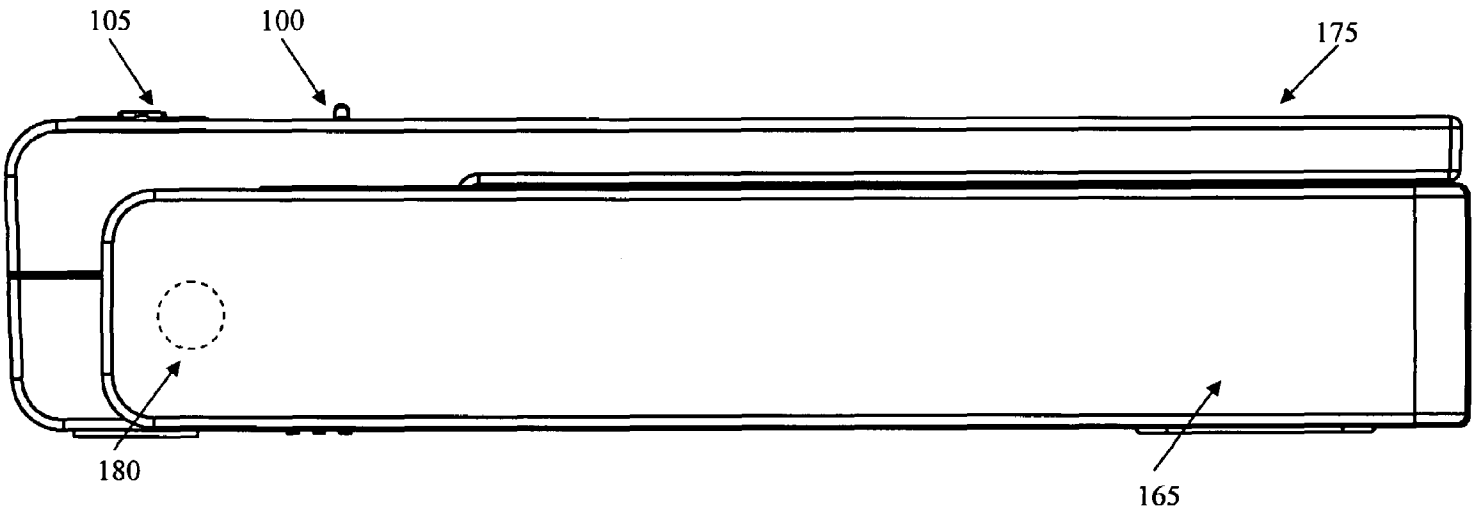
FIG. 4 is a right planar view of a preferred embodiment of the invention when closed.

FIGS. 1 through 21 illustrate various views of a preferred portable audio reproduction system embodiment of the present invention. As FIG. 1 illustrates, a preferred embodiment of the present invention includes power adapter 110, external audio input jack 115, headphone jack 120, and cable port 125.

Power adapter 110 preferably allows the portable audio reproduction system of the present invention to be powered from an external power source, such as, but not limited to, an AC to DC converter or external battery pack. In addition to receiving power from an external power source, the portable audio reproduction system can also preferably be powered by one or more batteries, which are preferably stored within the portable audio reproduction system, such as, but not limited to, in compartment 185 and/or compartment 190. Access to such compartments can be provided through removable covers, such as, but not limited to, covers 200. Although rechargeable batteries, such as, but not limited to, lithium ion batteries, are presently preferred, it should be apparent to one skilled in the art that disposable batteries can be substituted therefor without departing from the spirit or the scope of the invention.

In an embodiment in which rechargeable batteries are used, the rechargeable batteries are preferably recharged any time the portable audio reproduction system is connected to an external power source via power adapter 110. The portable audio reproduction system may also charge the batteries, and receive power, if a device implementing the Universal Serial Bus (USB), FireWire, or other such interface standards are connected thereto via cable port 125. In an embodiment in which rechargeable batteries are used, the batteries should preferably be of a capacity such that, if the portable audio reproduction system is disconnected from the external power source when the batteries are fully charged, the portable audio reproduction system can be powered and reproduce audio signals for several consecutive hours without needing to be recharged.

Power from power adapter 110, an externally connected device, and/or the batteries is preferably used to power a Class D or other audio amplifier housed within the portable audio reproduction system, as well as other aspects of the invention. A Class D amplifier is presently preferred because of the relatively high efficiencies associated with such amplifiers. Such efficiencies provide reduced power consumption over conventional amplifiers, thereby improving the system's battery life. The amplifier is preferably used to convert the audio signals from audio device 170 (illustrated in phantom in FIGS. 16 through 20 for clarity), preferably received via docking cradle 155 and/or from an external audio source connected to the present invention through external audio input jack 115, into a signal capable of driving speakers 160 and 165.

A preferred embodiment of the present invention also includes a differential-input mixer, which is capable of combining audio signals from audio device 170 with audio signals from an external audio source. A differential-input mixer is preferred as this can reduce the amount of noise propagated through the portable audio reproduction system. Examples of noise which can be reduced by a differential-input mixer include, but are not limited to, noise generated by the power supply in audio device 170, noise generated by an external audio device's power supply, noise generated by the power supply within the portable audio reproduction system, noise from an AC to DC converter, and the like.

Mixer control 135 preferably allows a user to adjust the relative strength with which each of the audio signals will be reproduced. By way of example, without intending to limit the present invention, a user can elect to listen solely to an audio signal from audio device 170, solely to an audio signal from the external audio source, or to a combination of the two audio signals, with, by way of example, twenty-five percent of the overall reproduced audio coming from audio device 170 and the remaining seventy-five percent coming from the external audio source. Although the previous example includes specific percentages, it should be apparent to one skilled in the art that mixer control 135 can allow a user to select from an effectively infinite set of input ratios. If the user has elected to have audio reproduced by the present invention include audio signals from multiple inputs, and if the portable audio reproduction system does not detect a device attached to one of the inputs, the present invention may automatically adjust the reproduced audio to be exclusively from the input on which an audio signal is detected. In addition to setting the relative volume of the inputs through mixer control 135, a user can also set the overall output level, or volume, by adjusting volume control 130.

In an alternative embodiment, controls 130 and 135 may operate as volume controls. In such an embodiment, by pressing control 130, a user can cause the volume of the audio reproduced by the portable audio reproduction system to decrease. Similarly, by pressing control 135, the volume of the audio reproduced by the portable audio reproduction system can be increased.

Regardless of whether implemented as controls 130 and 135 or mixer control 135 and volume control 130, the controls also preferably control audio signals sent to headphone jack 120. Locating headphone jack 120, cable port 125, power adapter 110, and audio input jack 115 near each other is presently preferred because it simplifies connecting the portable audio reproduction system to, and disconnecting the portable audio reproduction system from, the attached devices. Although locating headphone jack 120 near cable port 125, power adapter 110, and audio input jack 115 is presently preferred, it should be apparent to one skilled in the art that the physical location of headphone jack 120, cable port 125, power adapter 110, and audio input jack 115 can be varied without departing from the spirit or the scope of the invention. By way of example, without intending to limit the present invention, headphone jack 120 may be located on the front of one of speakers 160 and 165.

When audio device 170 is communicatively coupled with the portable audio reproduction system, audio device 170 may also receive power from the portable audio reproduction system. In one embodiment, the portable audio reproduction system may only supply power to audio device 170 when the portable audio reproduction system is receiving power from an external power source, such as, but not limited to, an AC to DC converter, or to an external device capable of providing power to the portable audio reproduction system. In an alternative embodiment, the portable audio reproduction system may supply power to audio device 170 regardless of whether the portable audio reproduction system is operating on power from an external power source or from internal batteries. In addition to allowing audio device 170 to function, power supplied by the portable audio reproduction system to audio device 170 may also allow audio device 170 to charge any rechargeable batteries stored therein.

Bar 205, which is preferably formed of the rear portion of speakers 160 and 165, preferably includes rubber pad 145. Rubber pad 145 can provide additional isolation between audio device 170 and the portable audio reproduction system. Bar 205 also preferably prevents the portable audio reproduction system from accidentally closing while the portable audio reproduction system is open and audio device 170 is attached thereto.

As FIGS. 1 through 7 illustrate, the present invention preferably includes protective surface 175, which protects speakers 160 and 165 from damage when the portable audio reproduction system is closed. In one embodiment, by depressing latch 140, a user can preferably unlock speakers 160 and 165 and articulate the speakers around hinge 180, thereby exposing speakers 160 and 165. Detents may be provided for controlling the angle of the speakers with respect to the protective surface. In another embodiment, speakers 160 and 165 can be held closed against protective surface 175 via friction or a passive latch. Because hinge 180 is preferably only nominally visible from the exterior of the portable audio reproduction system, hinge 180 is illustrated in phantom in the figures. Hinge 180 is preferably a hollow, barrel-type hinge, with cables for speakers 160 and/or 165 running therethrough. One or more rubber grommets are preferably used to isolate the vibrations from speakers 160 and 165 from the rest of the portable audio reproduction system. Rubber pad 145 and rubber feet 147 can further isolate the portable audio system, speakers 160 and 165, and audio device 170 from any vibrations.

Figure 9:
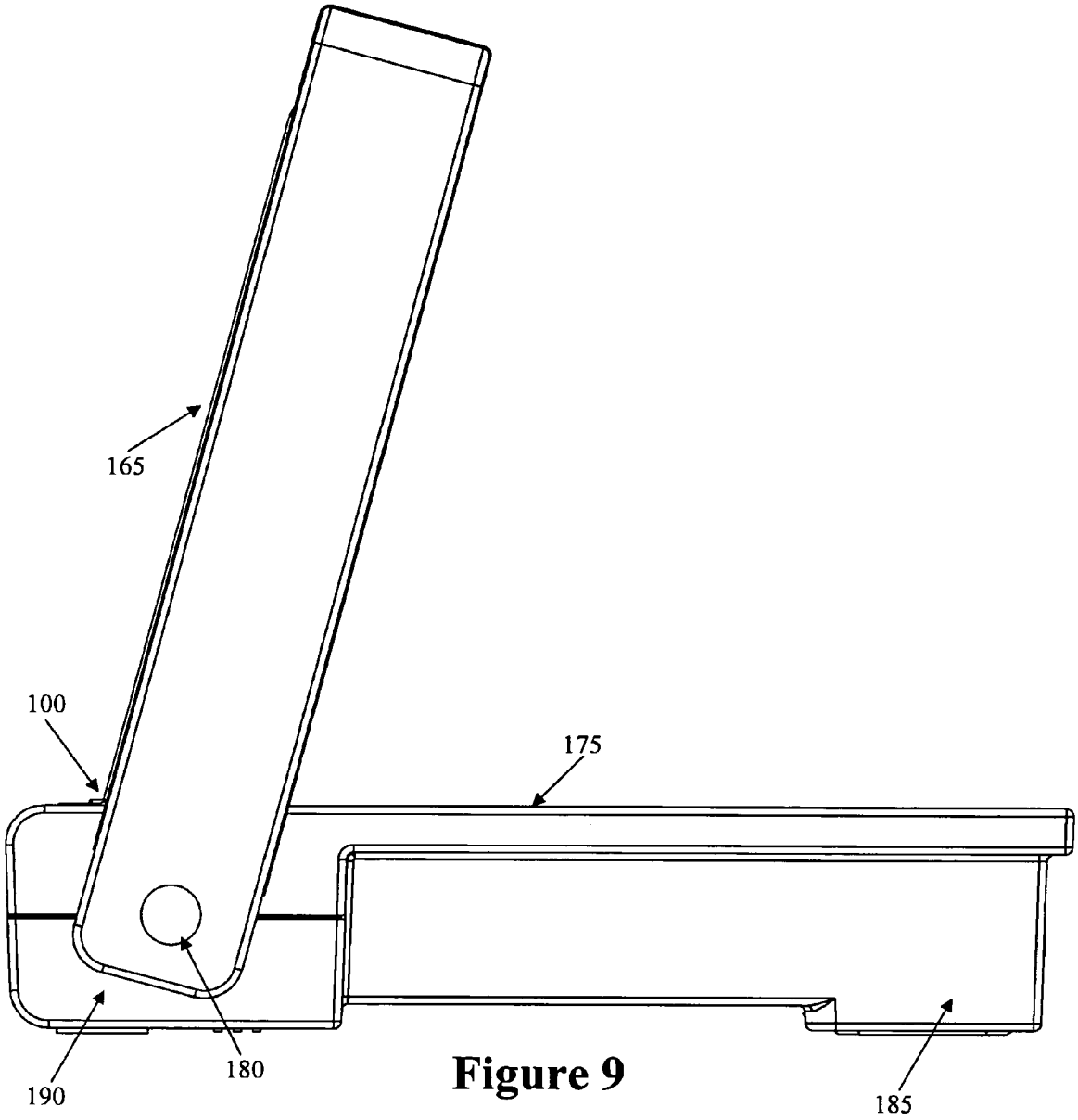
FIG. 9 is a right planar view of a preferred embodiment of the invention when open.
Figure 10:
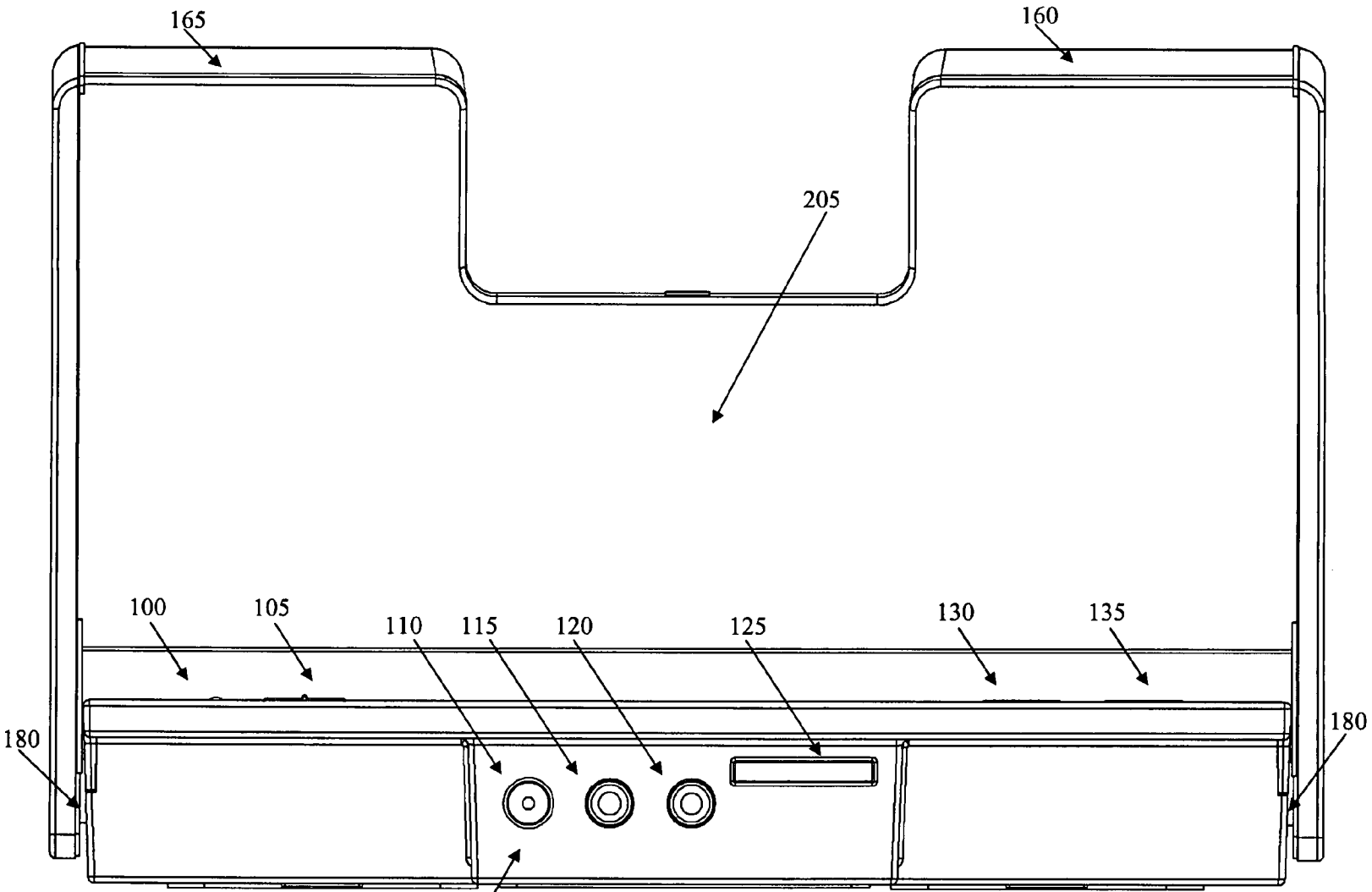
FIG. 10 is a rear planar view of a preferred embodiment of the invention when open.
Figure 11:
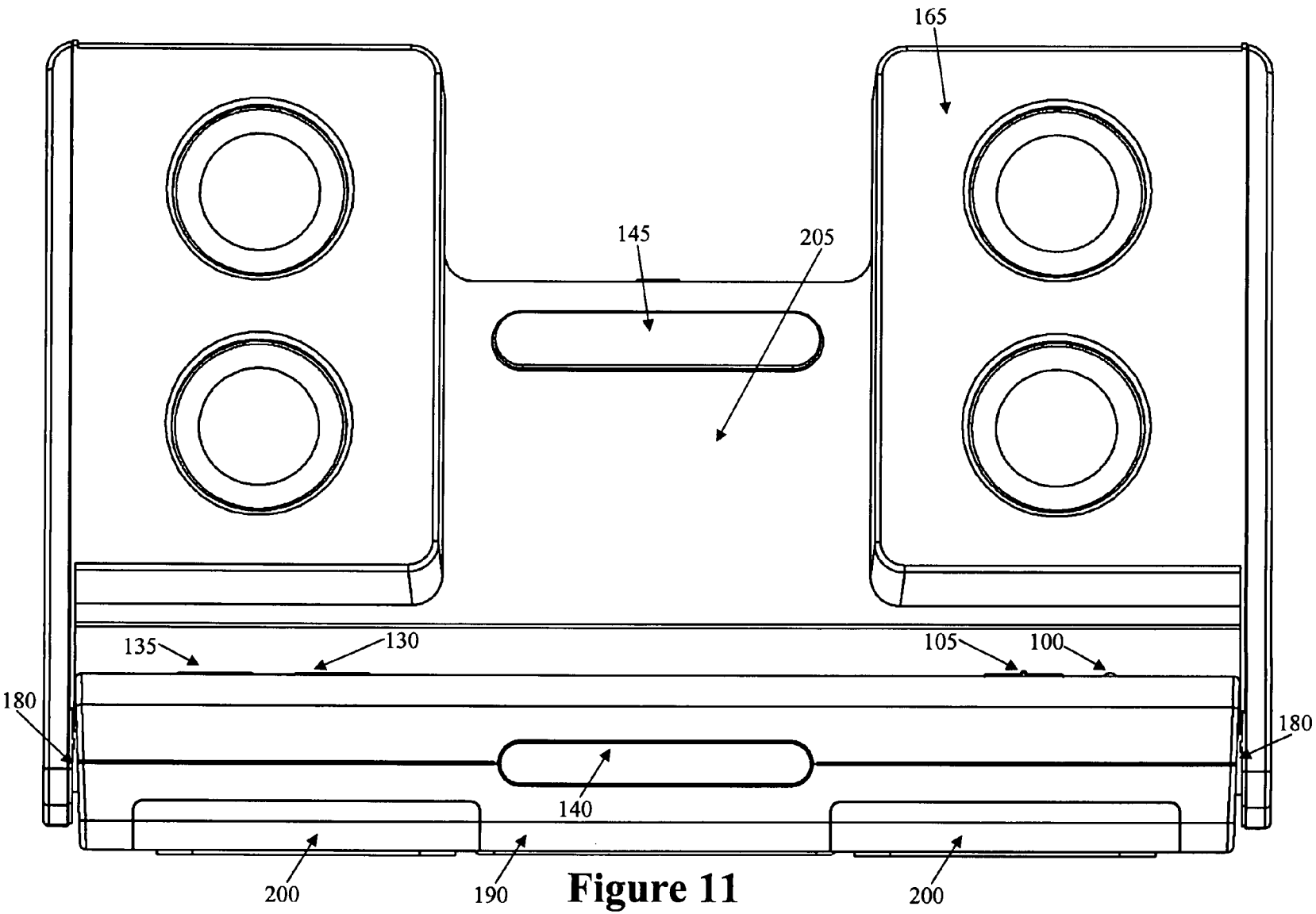
FIG. 11 is a front planar view of a preferred embodiment of the invention when open.
Figure 12:
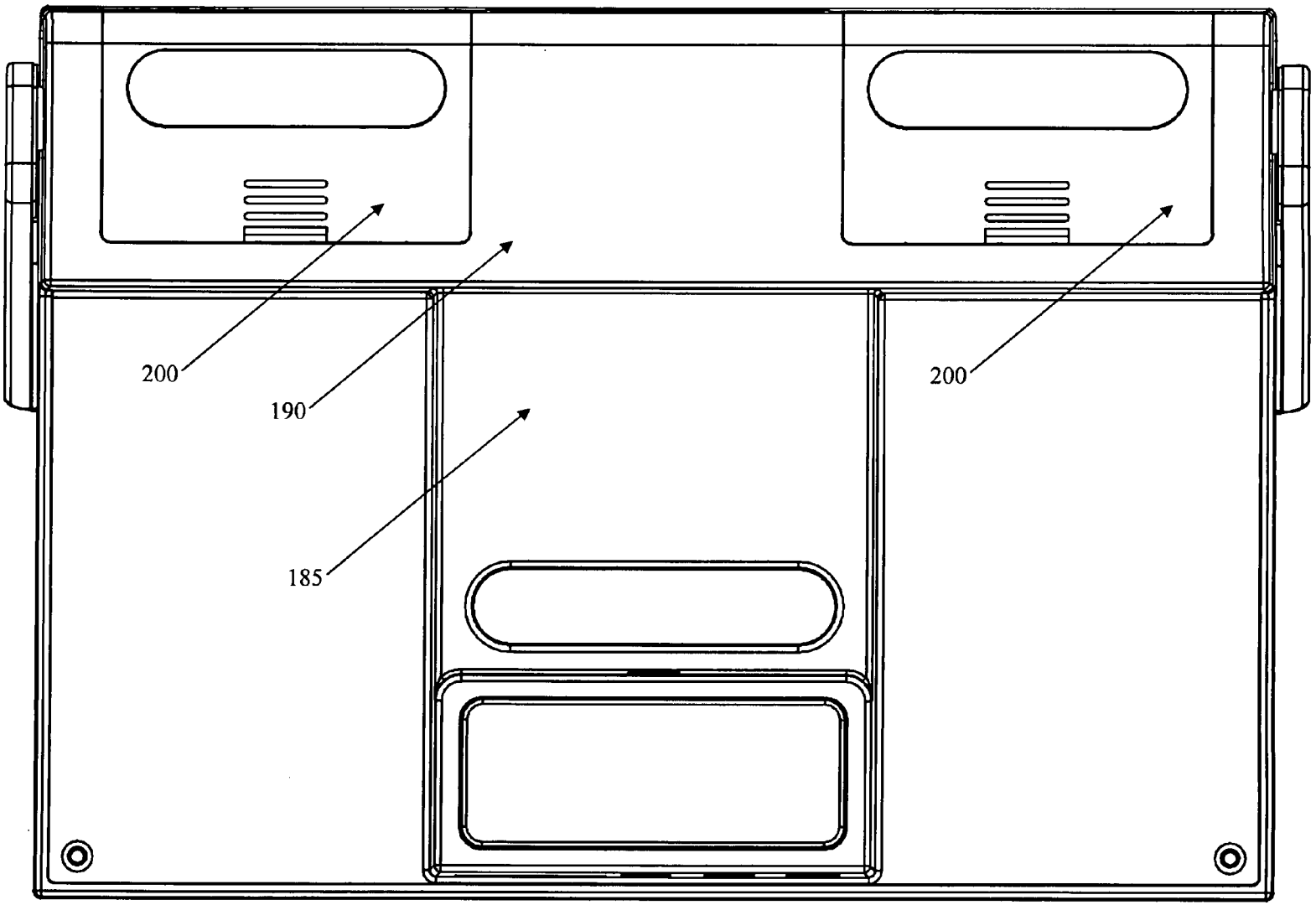
FIG. 12 is a bottom planar view of a preferred embodiment of the invention when open.
Figure 13:
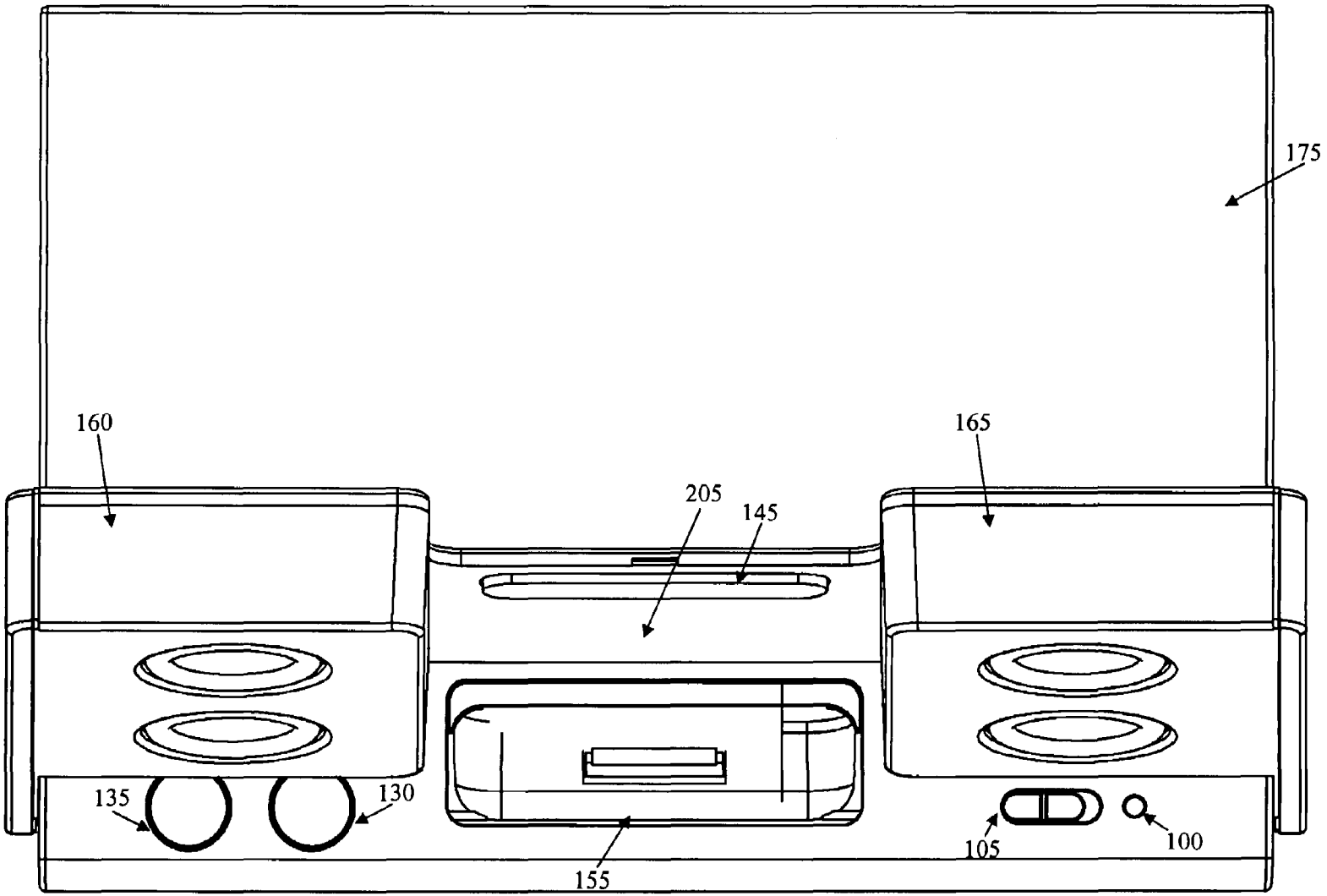
FIG. 13 is a top planar view of a preferred embodiment of the invention when open.
Figure 14:
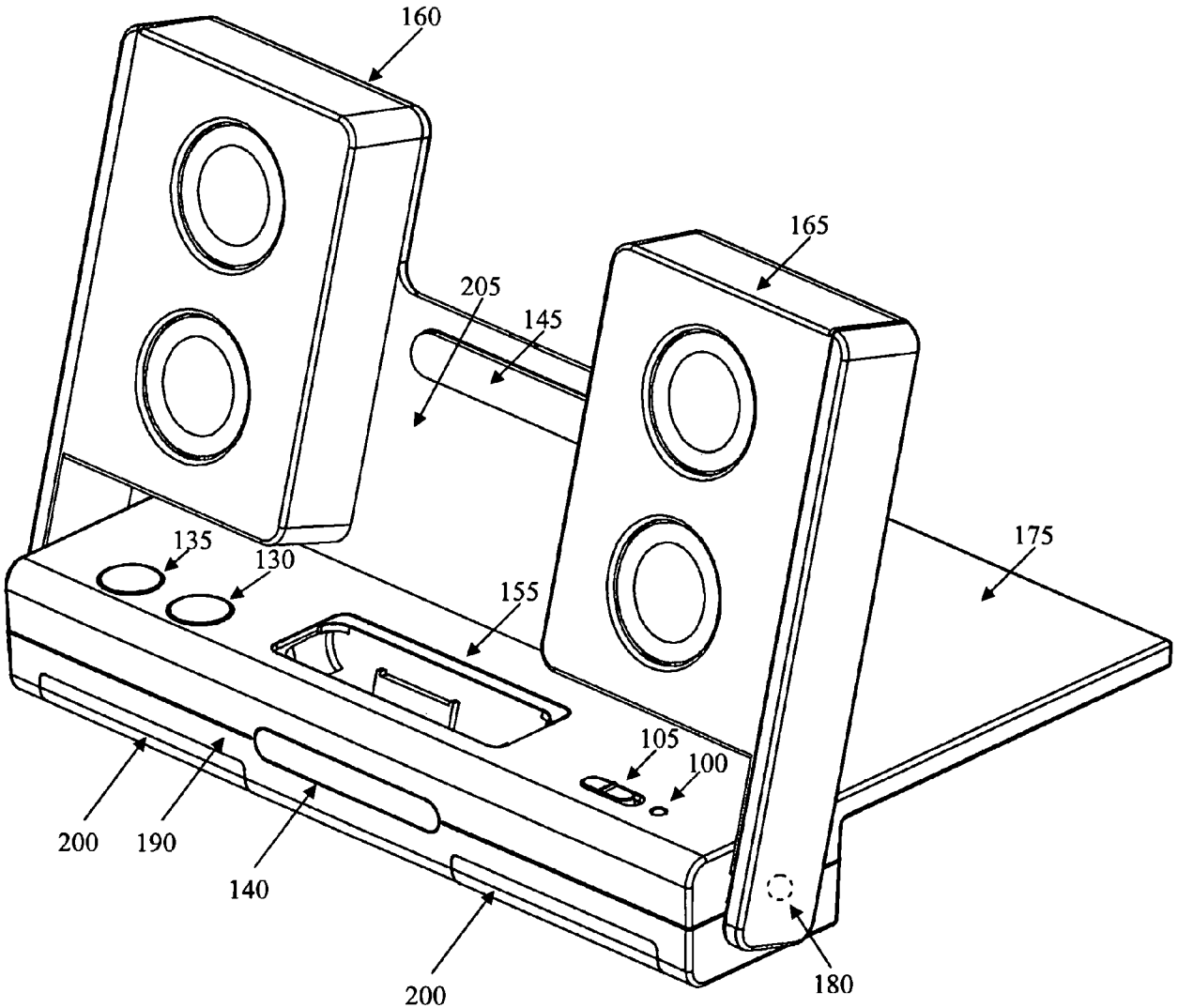
FIG. 14 is a front isometric view of a preferred embodiment of the invention when open.
Figure 15:
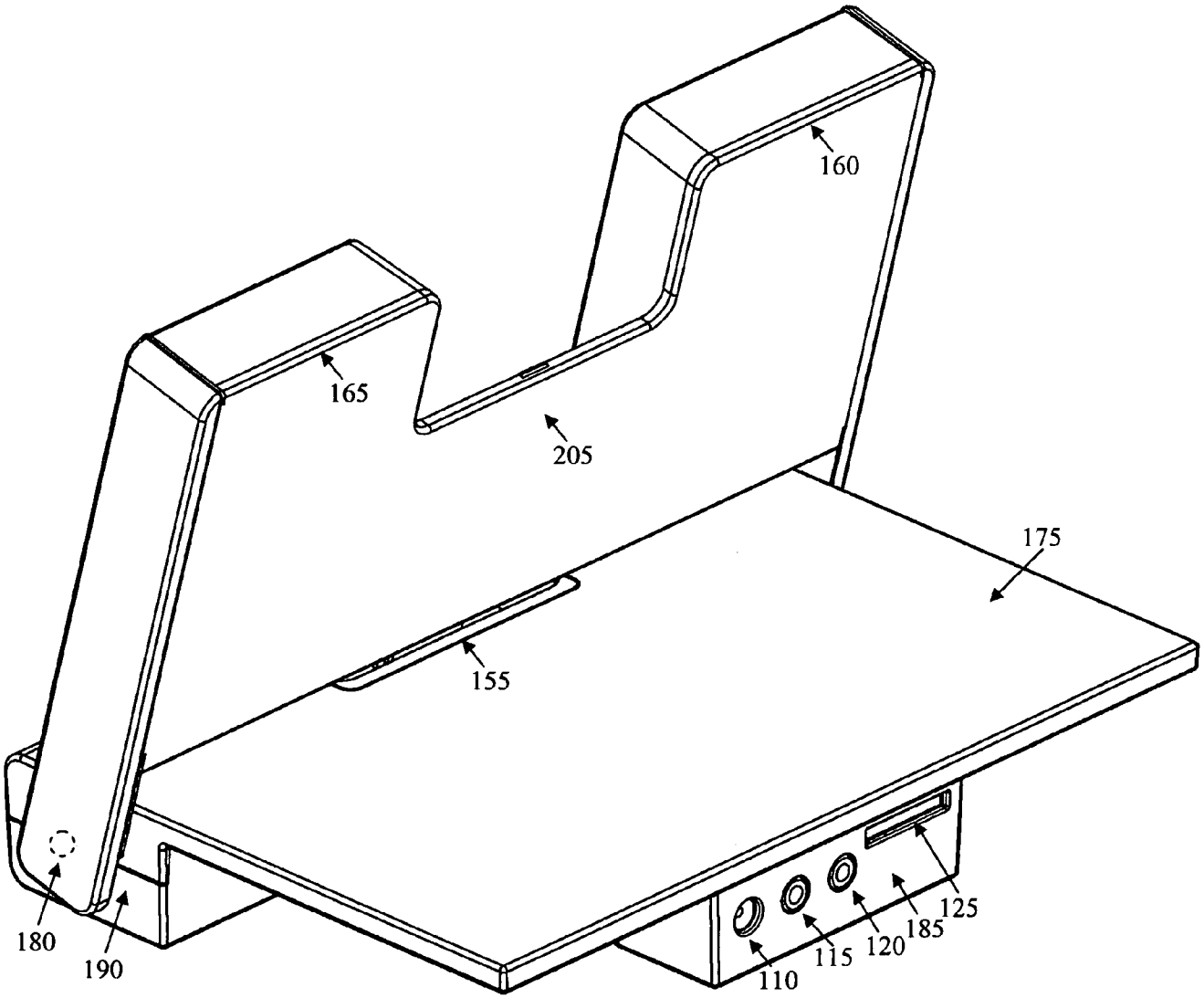
FIG. 15 is a rear isometric view of a preferred embodiment of the invention when open.
Figure 16:
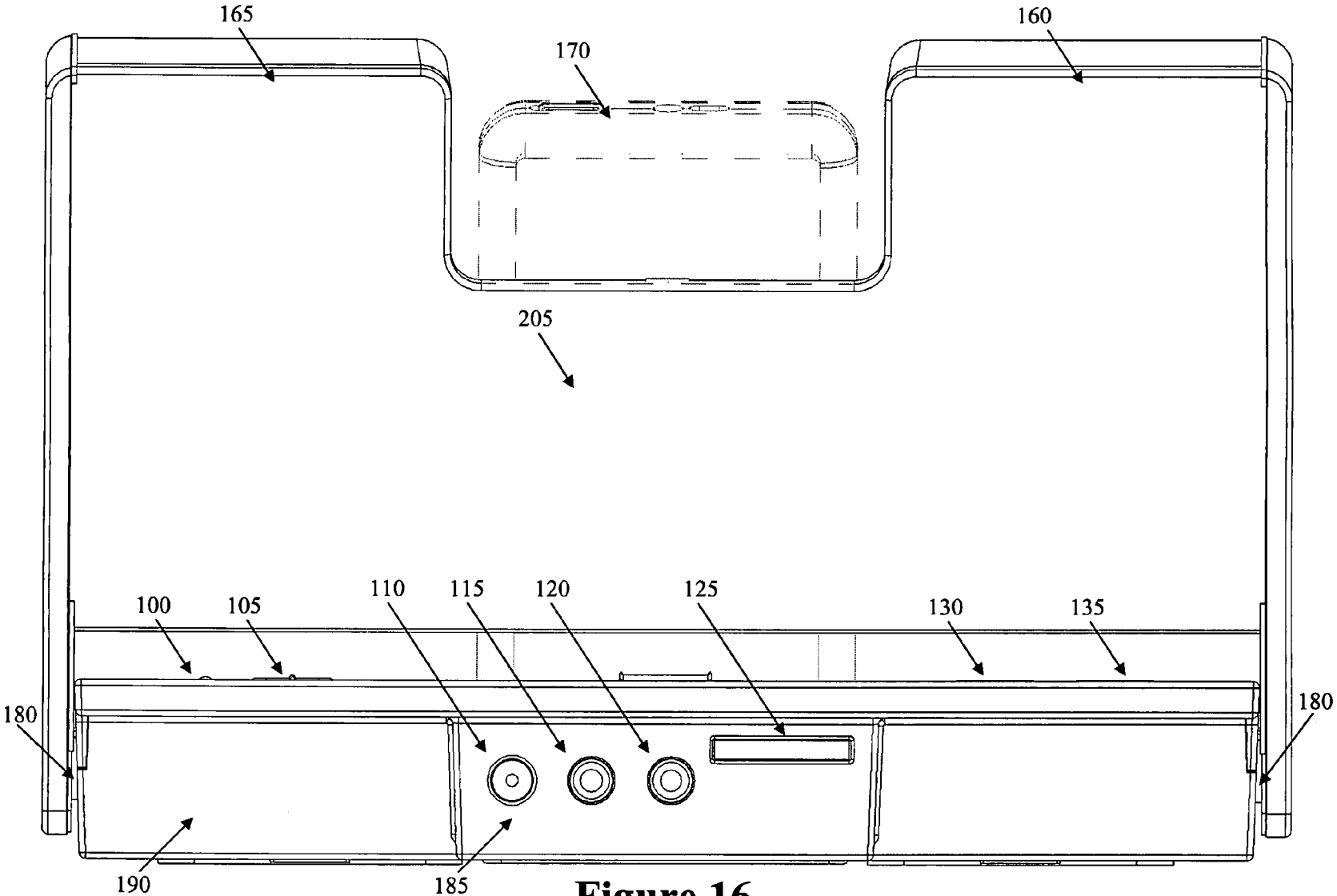
FIG. 16 is a rear planar view of a preferred embodiment of the invention when open, wherein a portable audio device has been attached to the invention.
Figure 17:
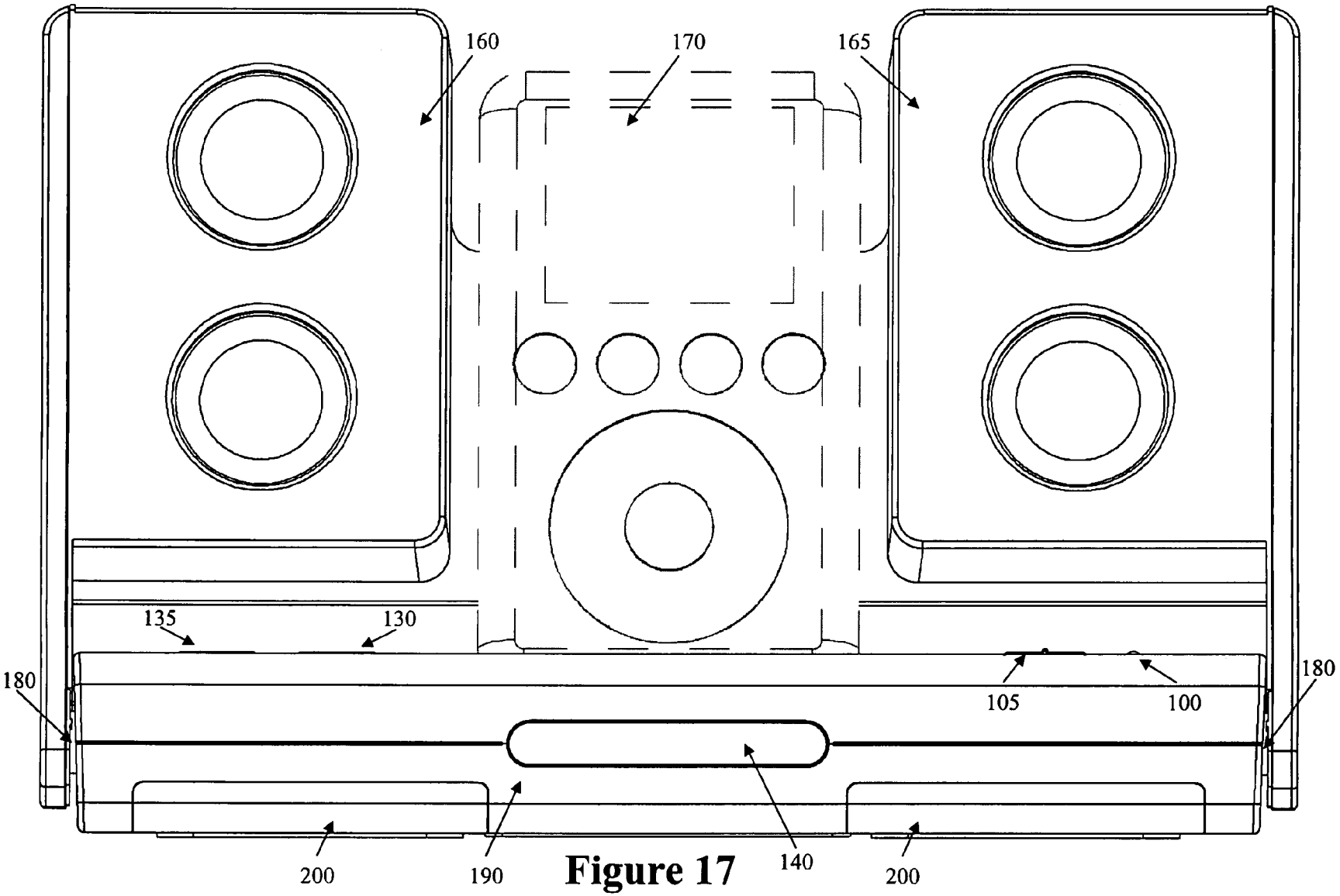
FIG. 17 is a front planar view of a preferred embodiment of the invention when open, wherein a portable audio device has been attached to the invention.
Figure 18:
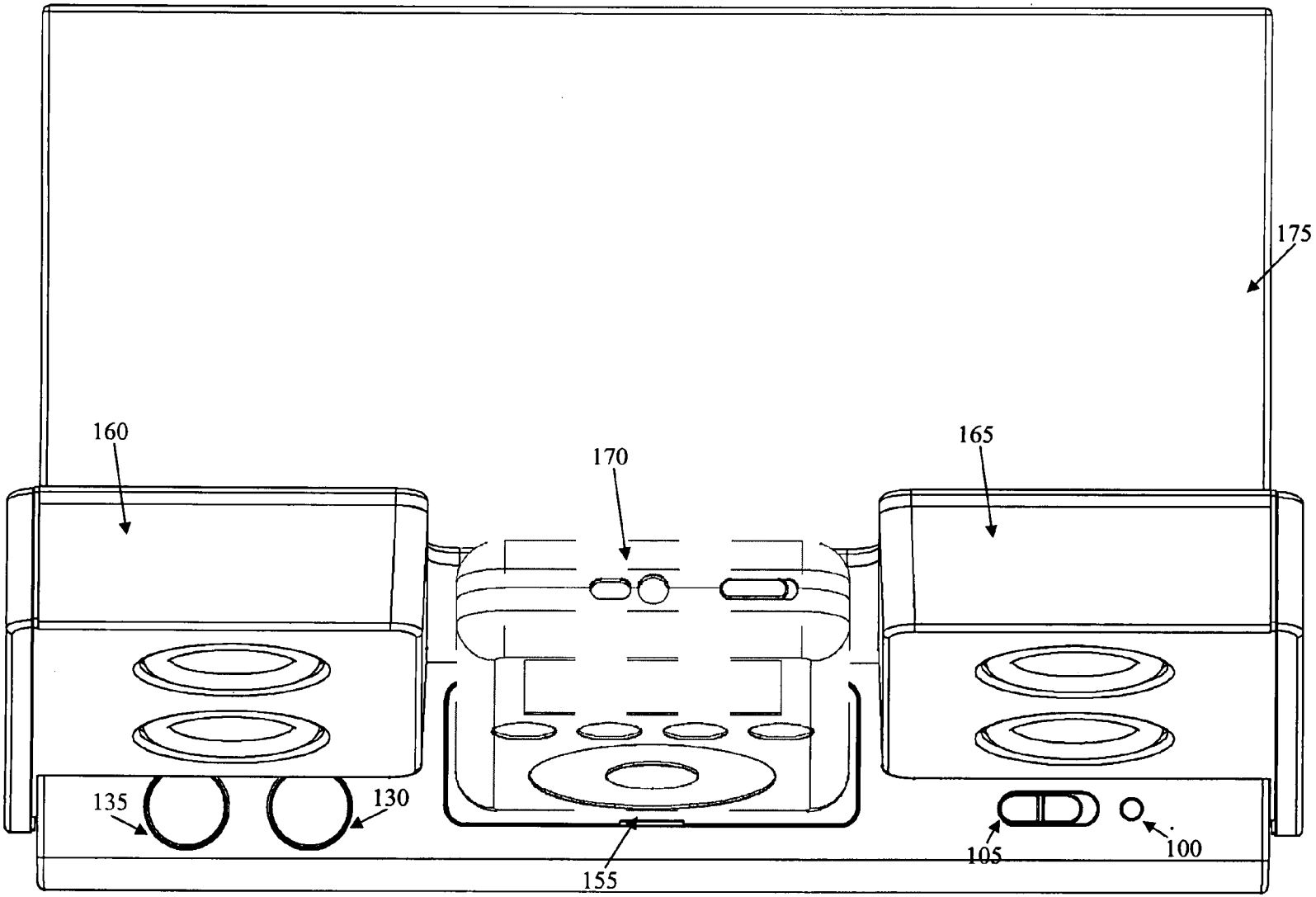
FIG. 18 is a top planar view of a preferred embodiment of the invention when open, wherein a portable audio device has been attached to the invention.
Figure 19:
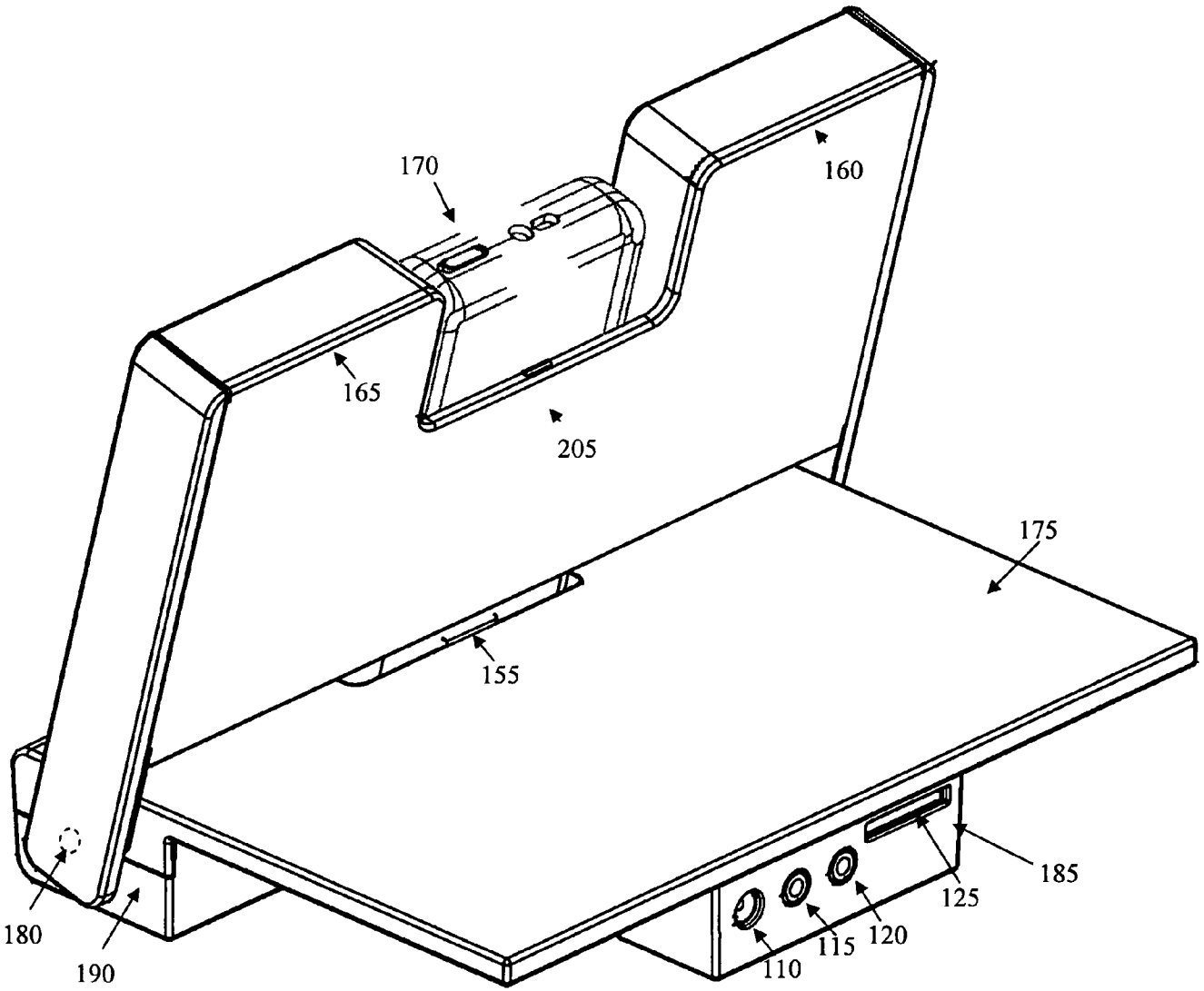
FIG. 19 is a rear isometric view of a preferred embodiment of the invention when open, wherein a portable audio device has been attached to the invention.
Figure 20:
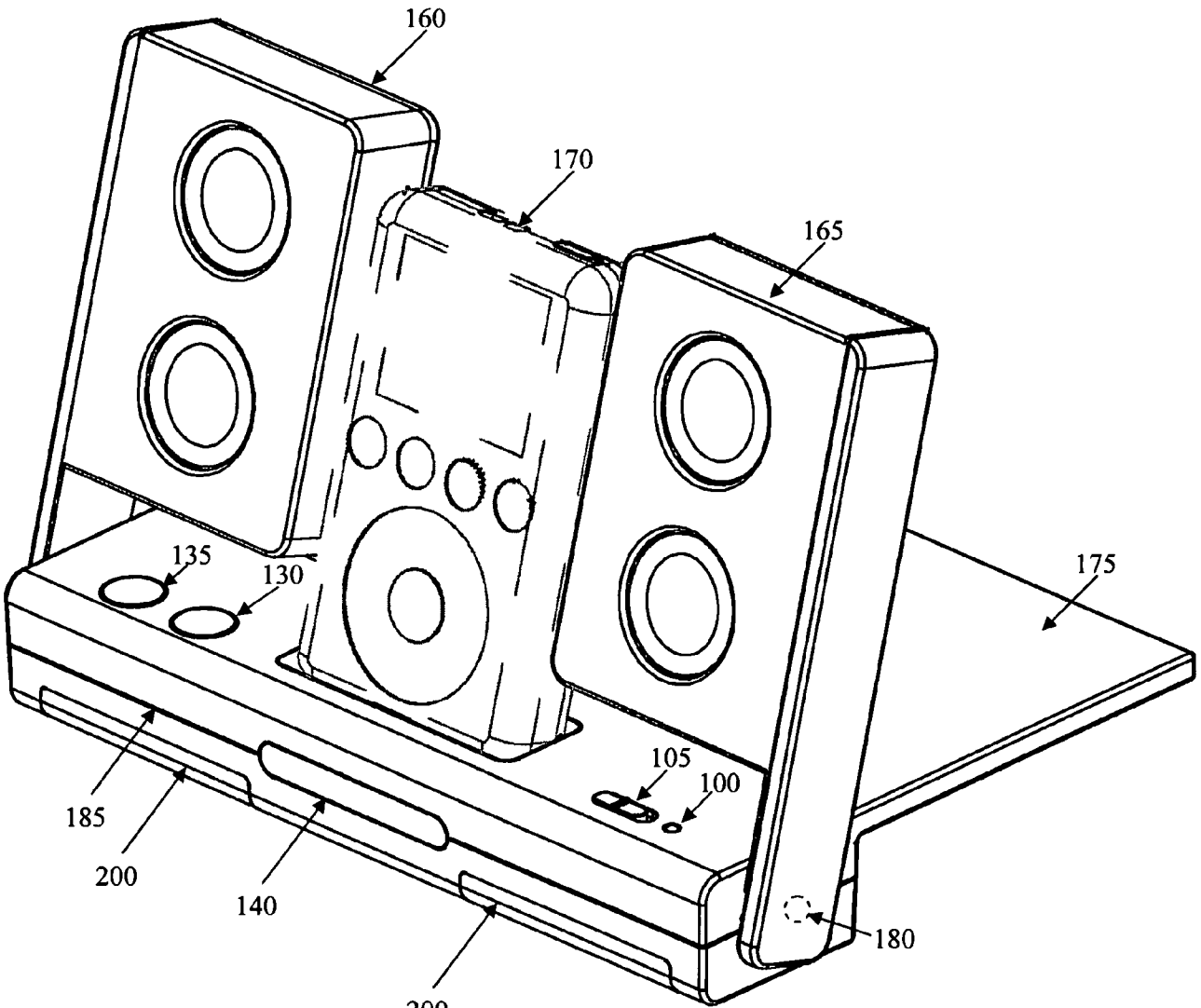
FIG. 20 is a front isometric view of a preferred embodiment of the invention when open, wherein a portable audio device has been attached to the invention.

As illustrated in FIGS. 9 and 10, when a user opens the portable audio reproduction system (i.e. transforms the portable audio reproduction system from a closed state to an open state), the user preferably rotates speakers 160 and 165 approximately 285 degrees around hinge 180 until speakers 160 and 165 come to rest against a hinge stop (not shown). This allows speakers 160 and 165 to be positioned at an angle that best aligns speakers 160 and 165 with an anticipated user position when the portable audio reproduction system is used on a desk or other surface and positioned within arm's reach of the user. Although an approximately 285 degree rotation is preferred, it should be apparent to one skilled in the art that the hinge stop position can be made adjustable, and that alternative rotation angles may be substituted therefor without departing from the spirit or the scope of the invention.

Although the illustrated invention permits speakers 160 and 165 to be positioned by way of hinge 180, alternative speaker positioning means are also envisioned. In one embodiment, the portable audio reproduction system may be of a "clamshell" design. In such an embodiment, protective surface 175 may sit against the desk or other surface on which the portable audio reproduction system rests, and speakers 160 and 165 may be hinged such that they fold down and are covered by protective surface 175 when the portable audio reproduction system is closed.

As illustrated in FIGS. 1 through 21, the portable audio reproduction system is preferably equipped with power switch 105, which allows a user to easily turn the system on and off. Light emitting diode (LED) 100 is preferably capable of displaying a plurality of colors and thereby conveying information to a user. By way of example, without intending to limit the present invention, LED 100 may be powered off, or dark, when the portable audio reproduction system is turned off, may glow green when the portable audio reproduction system is connected to an external power source, may glow yellow when the portable audio reproduction system is being powered by batteries, and may glow red when the portable audio reproduction system is being powered by batteries and the estimated remaining battery power drops below a given threshold.

Although power switch 105 can preferably be used to turn the portable audio reproduction system on and off, the portable audio reproduction system may ignore attempts to turn the portable audio reproduction system on when the portable audio reproduction system is closed. The portable audio reproduction system may also automatically power off when closed. These features can help prevent draining the batteries when the portable audio reproduction system is not in use.

Figure 21:
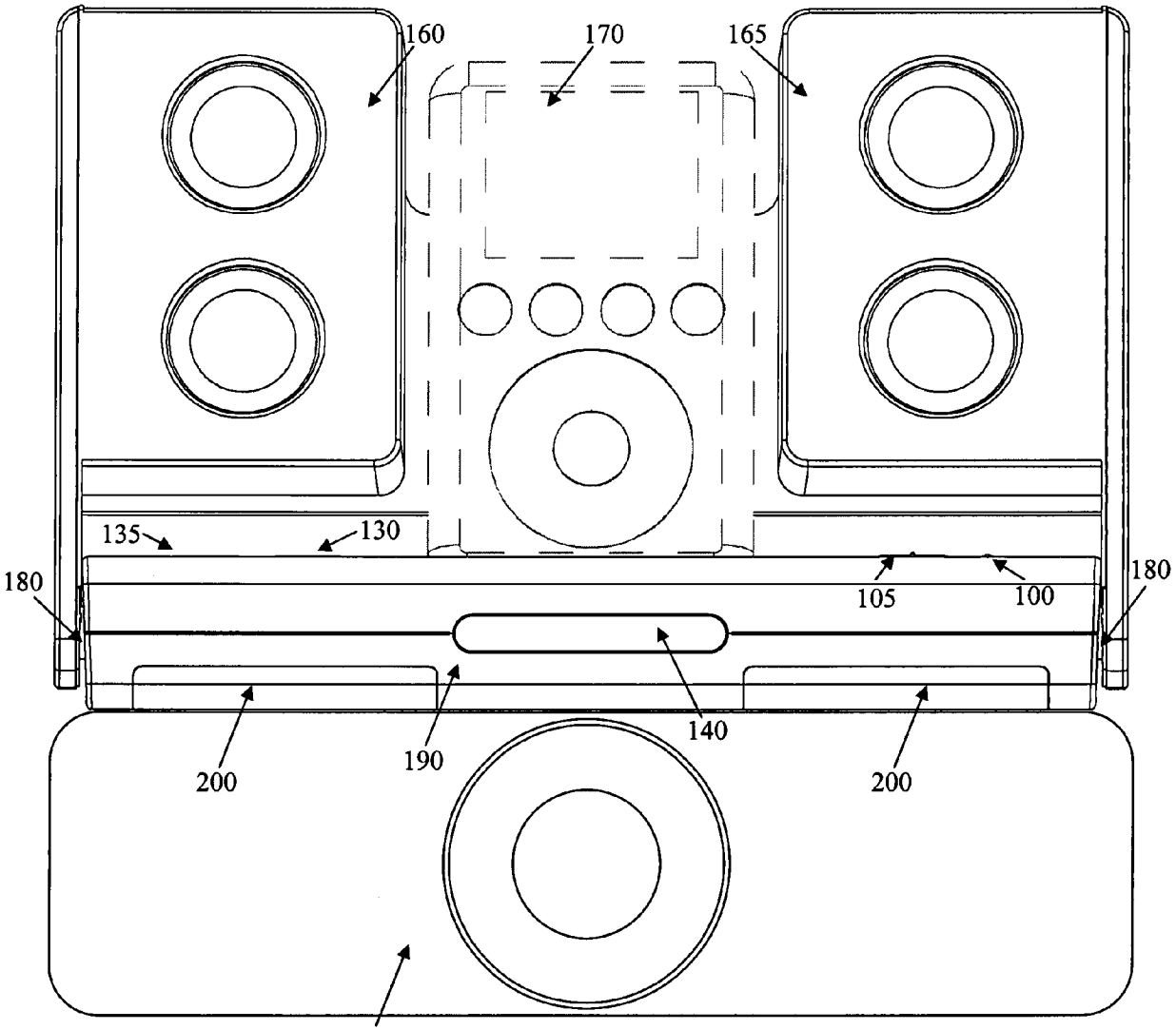
FIG. 21 is a front planar view of an embodiment of the invention when open, wherein a portable audio device and a subwoofer have been attached to the invention

As illustrated in FIG. 21, cable port 125 can allow the portable audio reproduction system to be easily connected to a wide range of high fidelity audio equipment, such as, but not limited to, subwoofer 195 or a home theater system. Cable port 125 can also allow the portable audio reproduction system to receive power and audio signals from the high fidelity audio equipment. Cable port 125 can thereby allow audio signals from audio device 170 and audio input jack 115 to be routed through an amplifier in subwoofer 195 prior to being reproduced by speakers 160 and 165. Still further, cable port 125 can allow audio device 170 to interface with a computer or other such device via docking cradle 155.

In an alternative embodiment, audio adapter 125 may be located on the bottom of the portable audio reproduction system, thereby allowing the portable audio reproduction system to connect with the high fidelity audio equipment by way of a docking cradle or other such attachment means. Such an arrangement may reduce the number of cables and other connectors a user must deal with when connecting and disconnecting the portable audio reproduction system.

Figure 5:
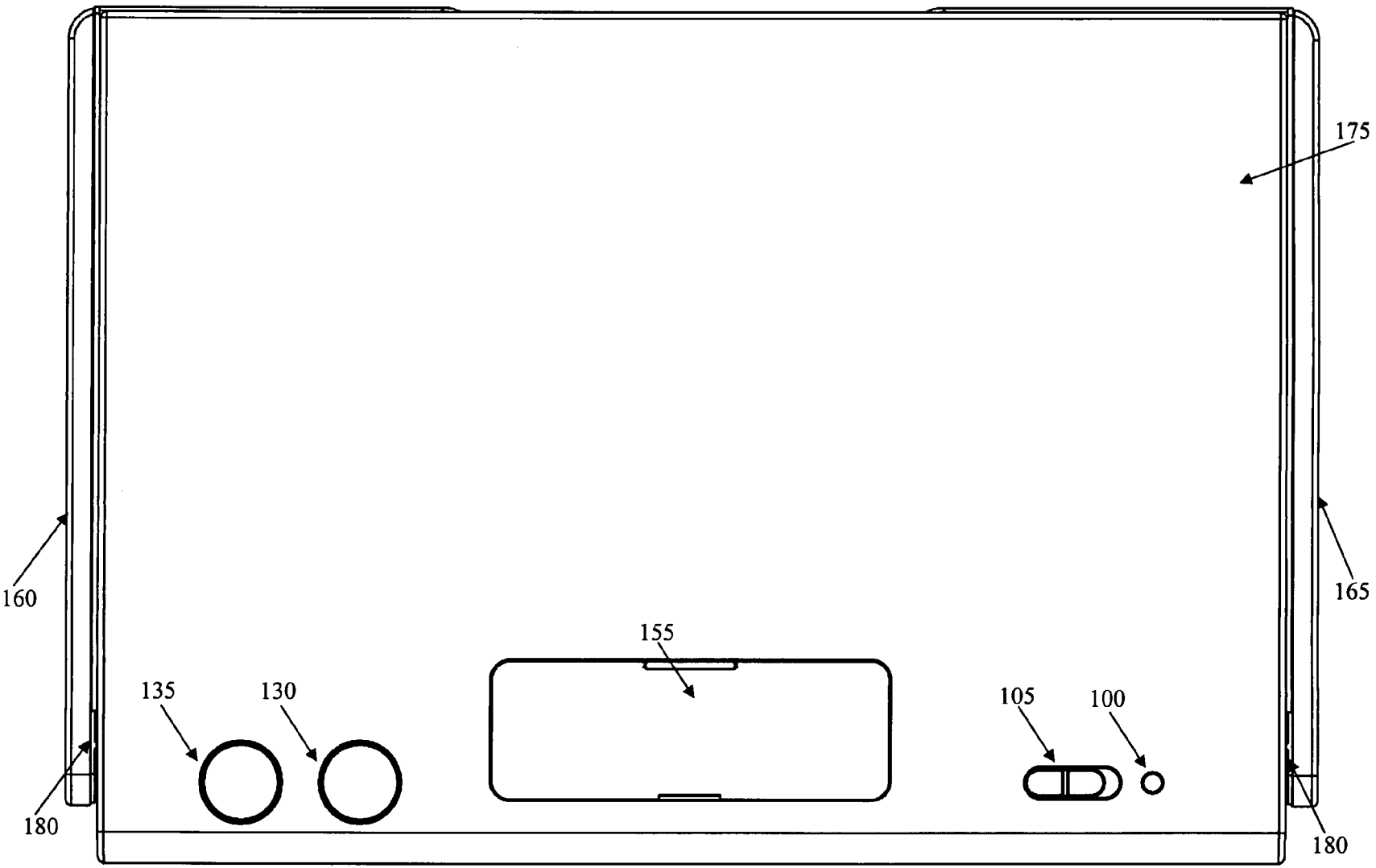
FIG. 5 is a top planar view of a preferred embodiment of the invention when closed.
Figure 6:
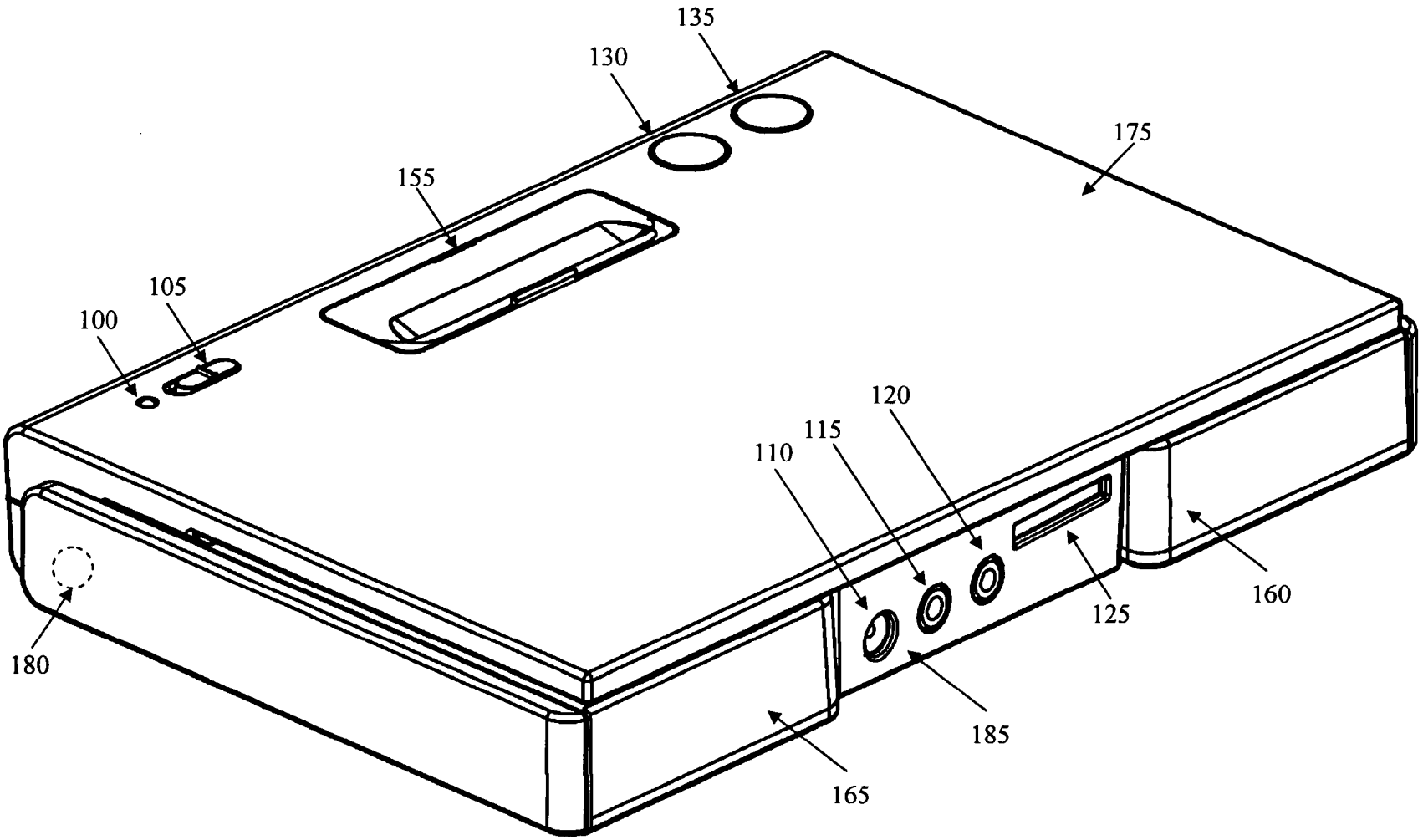
FIG. 6 is a rear isometric view of a preferred embodiment of the invention when closed.
Figure 7:
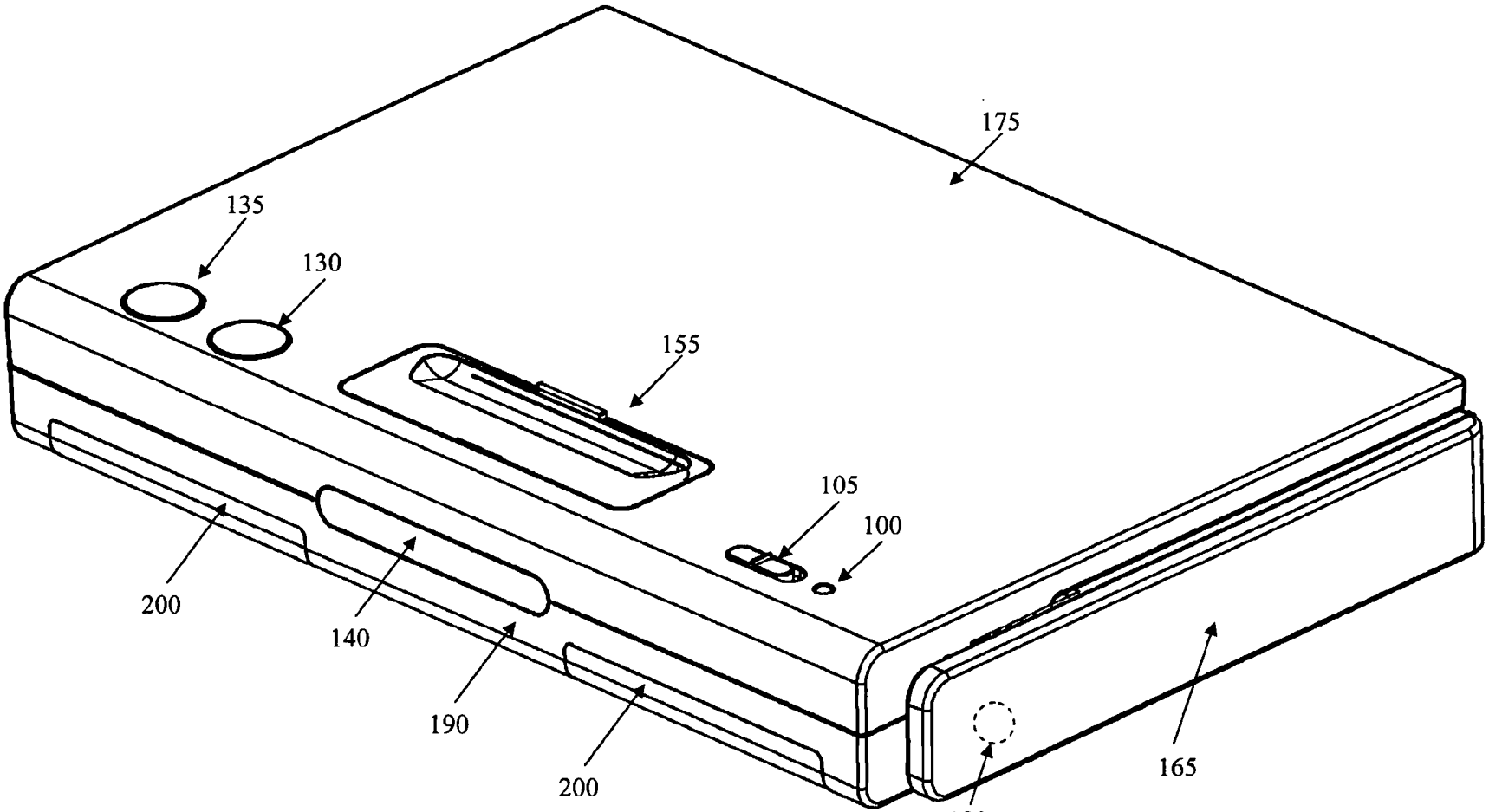
FIG. 7 is a front isometric view of a preferred embodiment of the invention when closed.
Figure 8:
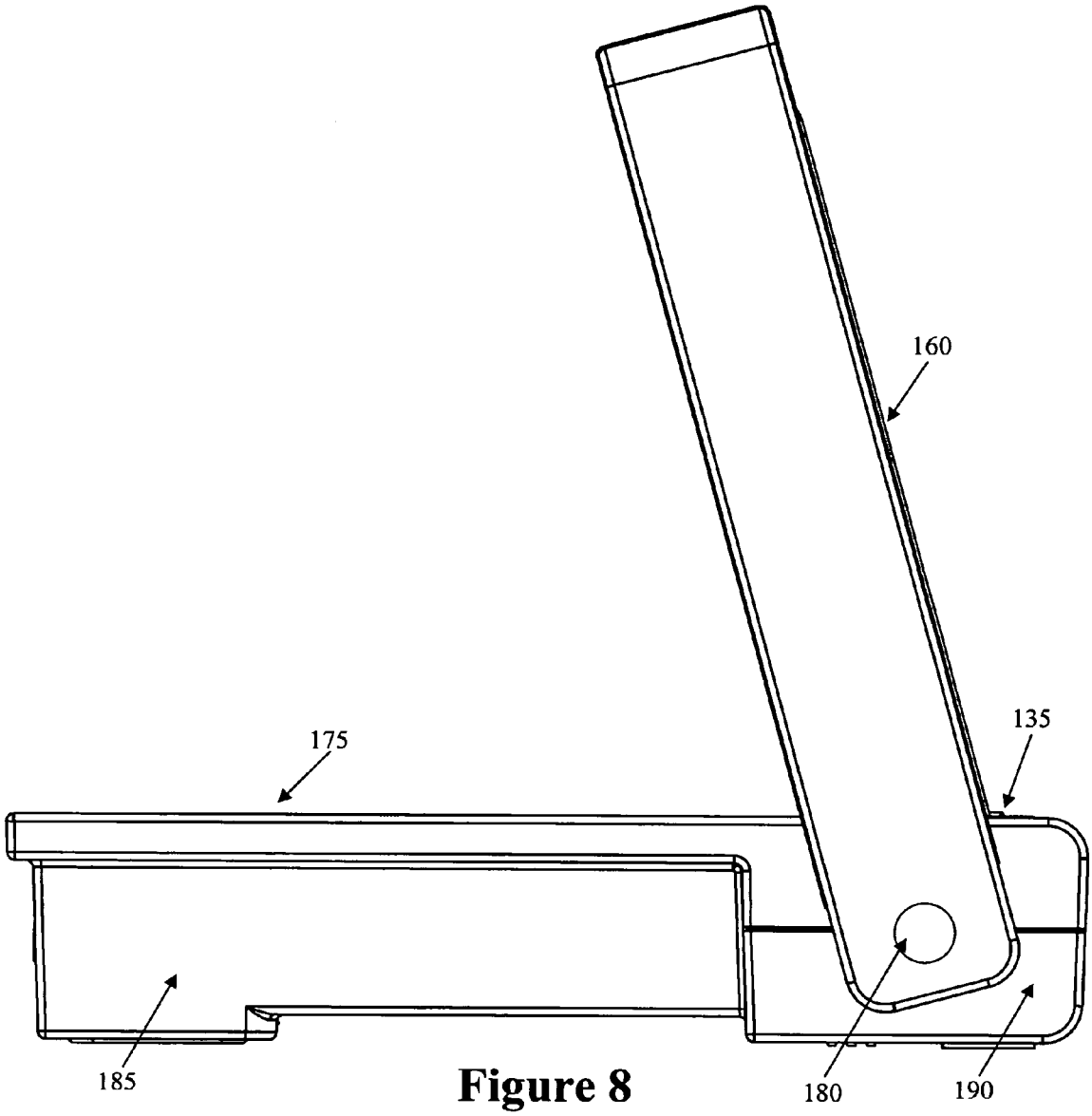
FIG. 8 is a left planar view of a preferred embodiment of the invention when open.

FIGS. 16 through 21 illustrate the docking of audio device 170 with the portable audio reproduction system via docking port 155. Although the illustrated embodiment of the present invention does not permit audio device 170 to be stored within the portable audio reproduction system when closed, as illustrated in FIG. 5, docking port 155 is preferably accessible even with the portable audio reproduction system is closed. This can allow the portable audio reproduction system to charge audio device 170 regardless of whether the portable audio reproduction system is open or closed.

In an alternative embodiment, the portable audio reproduction system may be configured to permit audio device 170 to be stored therein as the portable audio reproduction system is being transported. In such an embodiment, the portable audio reproduction system may recharge audio device 170 as needed.

Additional connectors, such as those supporting the Universal Serial Bus, Fire Wire, or other such standards, may also be added to the portable audio reproduction system, either individually or as part of cable port 125. Such connectors may allow the portable audio reproduction system to replace a docking station traditionally associated with an audio device, thus enabling audio device 170 to synchronize files with a computer.

The portable audio reproduction system may also be equipped with one or more handles or carrying straps. This can facilitate easily transporting the portable audio reproduction system.

While the invention has been described in detail and with reference to specific embodiments thereof, it will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A portable audio reproduction system, comprising:

first and second speaker housings, each comprising at least one speaker driver for reproducing sound;

a deck for providing a protective surface, the deck being connected to the speaker housings by at least one hinge;

the deck being rotatable about the hinge between first and second positions, the first position providing an open mode in which the speaker drivers are exposed and the second position providing a closed mode in which the speaker drivers are covered by the protective surface of the deck;

at least one audio adapter, operatively connected to the speaker drivers, for interfacing with an external electronic audio device so as to receive audio signals from the audio device for reproduction by the speaker drivers; and, at least one second surface between the first and second speaker housings, the at least one second surface preventing closing the portable audio reproduction system when an audio device is operatively connected to the at least one audio adapter.

2. The portable audio reproduction system of claim 1, wherein the hinge articulates through approximately 285 degrees as the portable audio reproduction system is transformed from the open mode to the closed mode.

3. The portable audio reproduction system of claim 1, further comprising a plurality of detents, through which the angle of the speakers with respect to the protective surface can be controlled.

4. The portable audio reproduction system of claim 1, wherein the at least one hinge is a barrel hinge.

5. The portable audio reproduction system of claim 4, further comprising a rubber grommet around the barrel hinge.

6. The portable audio reproduction system of claim 1, wherein the hinge allows the portable audio reproduction system to be opened and closed in a clamshell-like manner.

7. The portable audio reproduction system of claim 1, wherein the protective surface completely covers the plurality of speaker drivers when the portable audio reproduction system is closed.

8. The portable audio reproduction system of claim 1, further comprising an amplifier, communicatively coupled between the audio adapter and the speaker drivers.

9. The portable audio reproduction system of claim 8, wherein the amplifier is a Class D amplifier.

10. The portable audio reproduction system of claim 8, further comprising at least one power source, for powering the amplifier.

11. The portable audio reproduction system of claim 10, wherein the at least one power source is at least one battery.

12. The portable audio reproduction system of claim 11, wherein the at least one battery is rechargeable.

13. The portable audio reproduction system of claim 10, wherein the at least one power source is a DC power source.

14. The portable audio reproduction system of claim 10, wherein the at least one power source is an AC power source.

15. The portable audio reproduction system of claim 10, wherein the at least one power source further provides power to the audio device.

16. The portable audio reproduction system of claim 15, wherein the at least one power source provides power to the audio device regardless of whether the portable audio reproduction system is open or closed.

17. The portable audio reproduction system of claim 10, wherein the portable audio reproduction system automatically powers down when closed.

18. The portable audio reproduction system of claim 1, further comprising a volume control.

19. The portable audio reproduction system of claim 1, further comprising a cable port.

20. The portable audio reproduction system of claim 19, wherein the cable port allows the portable audio reproduction system to be connected to at least one external device.

21. The portable audio reproduction system of claim 20, wherein the external device is a subwoofer.

22. The portable audio reproduction system of claim 20, wherein the external device is a computer.

23. The portable audio reproduction system of claim 19, wherein the cable port is at the bottom of the portable audio reproduction system, thereby allowing the portable audio reproductions system to dock with external equipment.

24. The portable audio reproduction system of claim 1, further comprising a headset jack.

25. The portable audio reproduction system of claim 1, further comprising an auxiliary input jack.

26. The portable audio reproduction system of claim 25, further comprising a Class D amplifier.

27. The system of claim 26, wherein the Class D amplifier combines audio signals from the auxiliary input jack and the at least one audio adapter to create the audio signal to be reproduced by the system.

28. The portable audio reproduction system of claim 27, further comprising a headset jack, wherein the audio signal to be reproduced by the system is also sent to the headset jack.

29. The portable audio reproduction system of claim 1, wherein the incline of the speaker housings when the system is in the open mode is selected so as to provide optimum sound when the speaker housings are at an arm's length distance from a user's ears.

30. The portable audio reproduction system of claim 1, wherein the second surface engages the audio device to prevent closing of the portable audio reproduction system.

31. A portable audio reproduction system, comprising:

first and second speaker housings, each comprising at least one speaker driver for reproducing sound;

a deck for providing a protective surface, the deck being connected to the speaker housing by at least one hinge;

the deck being rotatable about the binge between first and second positions, the first position providing an open mode in which the speaker drivers are exposed and the second position providing a closed mode in which the speaker drivers are covered by the protective surface of the deck;

at least one audio adapter, operatively connected to the speaker drivers, for interfacing with an external electronic audio device so as to receive audio signals from the audio device for reproduction by the speaker drivers;

a cradle for receiving said external audio device; and, at least one second surface between the first and second speaker housings, the at least one second surface preventing closing the portable audio reproduction system when an audio device is cradled with said cradle.

32. A portable audio reproduction system, comprising:

at least one speaker housing comprising at least one speaker driver for reproducing sound;

a deck for providing a protective surface, the deck being connected to the speaker housing by at least one hinge;

the deck being rotatable about the hinge between first and second positions, the first position providing an open mode in which the speaker driver is exposed and the second position providing a closed mode in which the speaker driver is covered by the protective surface of the deck;

at least one audio adapter, operatively connected to the speaker driver, for interfacing with an external electronic audio device so as to receive audio signals from the audio device for reproduction by the speaker driver; and, at least one second surface operatively connected to the speaker housing, the at least one second surface preventing closing the portable audio reproduction system when an audio device is operatively connected to the at least one audio adapter.

* * * * *